United States Patent [19]

Flanagan

[11] Patent Number: 4,797,168

[45] Date of Patent: Jan. 10, 1989

[54] AZIDODINITRO PROPELLANTS

[76] Inventor: Joseph E. Flanagan, 20883 Kelvin Pl., Woodland Hills, Calif.

[21] Appl. No.: 895,082

[22] Filed: Aug. 11, 1986

[51] Int. Cl.[4] ..... C06B 25/00
[52] U.S. Cl. ..... 149/88; 149/119
[58] Field of Search ..... 149/88, 119

[56] References Cited

U.S. PATENT DOCUMENTS

| | | | |
|---|---|---|---|
| 3,883,377 | 5/1975 | Wright | 149/88 |
| 4,141,910 | 2/1979 | Flanagan et al. | 149/88 |
| 4,427,466 | 1/1984 | Flanagan et al. | 149/88 |
| 4,472,311 | 9/1984 | Frankel et al. | 260/349 |

*Primary Examiner*—Edward A. Miller

[57] ABSTRACT

A liquid propellant comprising a mixture of an energetic azido fuel such as 1,1,1-azidodinitroethane, a diluent such as methanol and azidoethanol and mixtures thereof.

1 Claim, No Drawings

AZIDODINITRO PROPELLANTS

BACKGROUND OF THE INVENTION

1. Field of the Invention

This invention relates to propellants and, more specifically, to advanced liquid compositions for propellant application.

2. Description of the Prior Art

Liquid propellants include all of the various fluids used to generate energy. These fluids may be a mixture of an oxidizer and a combustible or a single compound. They include, but are not limited to, oxidizers, fuels, catalysts, and inert additives.

To be practical, a liquid propellant must be chemically and ballistically stable while concurrently capable of generating hot combustion gases when pressurized, heated or fed through a catalyst.

An extensive variety of liquid propellants have been tested over the past two decades. However, it has been impossible to find one which provides ideal stability, performance and low toxicity.

Hydrazine and aqueous hydrazine solutions are representative of presently available propellants. Although they have been utilized for propellant applications for the past two decades, concerns about the toxicity and carcinogenic nature of hydrazine have limited the use of the systems. Additionally, hydrazine systems are decomposed by passing the liquid over an expensive metallic catalyst which must be replaced periodically. The present invention overcomes these types of problems.

SUMMARY OF THE INVENTION

Accordingly, there is provided by the present invention a new family of liquid propellants. These propellants comprise an intimate admixture of an azidodinitro compound and a diluent such as azido alcohols.

OBJECTS OF THE INVENTION

Therefore, it is an object of this invention to provide a new family of liquid propellant mixtures can be substituted for hydrazine systems without a loss in the overall system performance.

Another object of the present invention is to provide a propellant having a reduced toxicity level.

Still a further object of the present invention is to provide a chemically and ballistically stable propellant.

Other objects, advantages and novel features of the present invention will become apparent from the following detailed description of the invention.

DESCRIPTION OF THE PREFERRED EMBODIMENT

In accordance with the present invention, there is provided a family of new liquid propellants which comprise an azidodinitro compound and a diluent. Basically, this family of propellants comprises a mixture of an energetic azidodinitro compound such as 1,1,1-azidodinitroethane (AZDNE) and a diluent such as methanol or ethanol, or the azido alcohols including 1-azidoethanol, 1,3-diazidopropanol, 1,1,1-azidodinitrobutanol, 1,5-diazido-3-nitrozapentane (DANPE) and 1,4-diazido-1,1-dinitrobutane.

The energetic azido fuel of choice is 1,1,1-azododinitroethane which may be prepared by reacting the corresponding 1,1,1-trinitromethyl compound with lithium azide in the presence of a dipolar aprotic solvent such as described in U.S. Pat. No. 4,472,311 issued to Frankel et al.

Alternatively, the 1,1,1-azidodinitro compounds may be prepared by the electrolysis of a slightly alkaline aqueous solution of a primary gemdinitroalkane and sodium azide at a smooth platinum electrode. This work is described in U.S. Pat. No. 3,883,377 to C. M. Wright entitled "1-Azido-1,1-Dinitroalkanes".

As previously noted the diluents which may be utilized in the present invention include methanol, or the azido alcohols represented by:

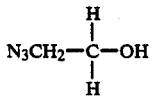

(1)

and

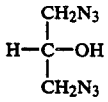

(2)

which are 1-azidoethanol (TAE), 1,3-diazidopropanol (DAZP), respectively, and

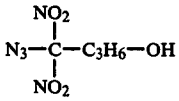

(3)

as well as 1,5-diazido-3-nitroazapentane (DANPE) and 1,4-diazido-1,1,-dinitrobutane. The diluents are utilized to reduce the freezing point of the fuel mixture, tailor the flame temperature and desensitize the mixture.

The energetic azido fuels serve to increase the overall enthalpy of the system by the presence of the highly exothermic azido moieties, in which the oxygen to carbon ratio is greater than one ($O/C \geqq 1$).

Table 1 summarizes the theoretical performance of selected propellant mixtures. For comparison, the specific impulse performance of hydrazine and pure 1,1,1-azidodinitroethane (AZDNE) is provided.

TABLE 1

THEORETICAL SPECIFIC IMPULSE PERFORMANCE OF SELECTED PROPELLANTS ($300\ psi \rightarrow \epsilon = 40$)

| Propellant composition (w/o) | Isp, Seconds |
|---|---|
| $N_2H_4$ (50% $NH_3$) | 241.1 |
| $N_3(NO_2)_2CCH_3$ (AZDNE) | 320.9 |
| 90 AZDNE/10 MeOH | 302.5 |
| 80 AZDNE/20 MeOH | 280.1 |
| 90 AZDNE/10 EtOH | 296.9 |
| 80 AZDNE/20 EtOH | 269.6 |
| 90 AZDNE/10 $N_3C_2H_4OH$ | 313.2 |
| 80 AZDNE/20 $N_3C_2H_4OH$ | 303.3 |
| 70 AZDNE/30 $N_3C_2H_4OH$ | 292.3 |
| 90 AZDNE/10 $(N_3CH_2)_2CHOH$ | 315.3 |
| 80 AZDNE/20 $(N_3CH_2)_2CHOH$ | 307.8 |
| 90 AZDNE/10 $N_3C(NO_2)_2C_3H_6OH$ | 316.9 |
| 80 AZDNE/20 $N_3C(NO_2)_2C_3H_6OH$ | 312.3 |
| 90 AZDNE/10 $O_2NN(CH_2CH_2N_3)_2$ | 318.2 |
| 80 AZDNE/20 $O_2NN(CH_2CH_2N_3)_2$ | 314.5 |
| 90 AZDNE/10 $N_3C(NO_2)_2C_3H_6N_3$ | 318.9 |
| 80 AZDNE/20 $N_3C(NO_2)_2C_3H_6N_3$ | 316.6 |

As seen in Table 1 the improved liquid propellants are compared to hydrazine with respect to specific impulse. As noted, the new liquid propellants are much more energetic than hydrazine while maintaining excellent ignition characteristics without the utilization of a catalyst.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A desensitized liquid monopropellant comprising from about 70 to about 90 weight percent 1,1,1-azidodinitroethane, and from about 10 to about 30 weight percent of a desensitizing diluent selected from the group consisting of $N_3C_2H_4OH$, $(N_3CH_2)_2CHOH$, $N_3C(NO_2)_2C_3H_6OH$, $O_2NN(CH_2CH_2N_3)_2$, $N_3C(NO_2)_2C_3H_6N_3$, and mixtures thereof.

* * * * *

UNITED STATES PATENT AND TRADEMARK OFFICE

CERTIFICATE OF CORRECTION

PATENT NO. : 4,797,168

DATED : January 10, 1989

INVENTOR(S) : Joseph E. Flanagan

It is certified that error appears in the above-identified patent and that said Letters Patent is hereby corrected as shown below:

Front page, first column

"[76] Inventor: Joseph E. Flanagan, 20883 Kelvin Pl., Woodland Hills, Calif." should read:

-- [75] Inventor: Joseph E. Flanagan, Woodland Hills, Calif.--

Add:

-- [73] Assignee: Rockwell International Corporation--

Signed and Sealed this

Nineteenth Day of March, 1991

*Attest:*

HARRY F. MANBECK, JR.

*Attesting Officer*

*Commissioner of Patents and Trademarks*